US006758733B2

(12) United States Patent
Wiand

(10) Patent No.: US 6,758,733 B2
(45) Date of Patent: Jul. 6, 2004

(54) TWO-PART BEVELING WHEEL FOR IMPROVED POSITIONING OF BEVEL CONTOURS ON OPHTHALMIC LENSES

(76) Inventor: Ronald C. Wiand, 1494 Heatherwood Dr., Troy, MI (US) 48098

( * ) Notice: Subject to any disclaimer, the term of this patent is extended or adjusted under 35 U.S.C. 154(b) by 104 days.

(21) Appl. No.: 10/098,008

(22) Filed: Mar. 13, 2002

(65) Prior Publication Data

US 2003/0176155 A1 Sep. 18, 2003

(51) Int. Cl.[7] ..... B24B 25/00

(52) U.S. Cl. ..... 451/461; 451/43; 451/44; 451/58; 451/284

(58) Field of Search ..... 451/461, 43, 44, 451/58, 284, 256, 9; 51/298, 307, 308, 309

(56) References Cited

U.S. PATENT DOCUMENTS 3,919,811 A * 11/1975 Hedelin ..... 451/540
4,612,736 A * 9/1986 Massard et al. ..... 451/5
4,829,715 A * 5/1989 Langlois et al. ..... 451/9
4,841,676 A * 6/1989 Barwasser ..... 451/461
4,908,996 A * 3/1990 Friedman et al. ..... 451/43
5,161,333 A * 11/1992 Lecerf et al. ..... 451/21
5,410,843 A * 5/1995 Gottschald ..... 451/43

* cited by examiner

*Primary Examiner*—Lee D. Wilson
*Assistant Examiner*—Alvin J. Grant
(74) *Attorney, Agent, or Firm*—Warn, Hoffmann, Miller & LaLone, P.C.

(57) ABSTRACT

A bevel edging wheel is described which has differing hardness abrasive matrices on the bevel cutting surfaces. The bevel edging wheel, which is suitable for edge finishing of an optical lens, includes: (1) a hub portion for attachment to a rotary power source: and (2) an outer circumferential cutting surface having a width, the surface including a bevel edging portion including a first abrasive surface and a second abrasive surface adapted for forming a bevel edge on a lens. The first abrasive surface comprises a first abrasive matrix, and the second abrasive surface comprises a second abrasive matrix wherein one of the first abrasive matrix or the second abrasive matrix has an effective hardness greater than the other.

20 Claims, 2 Drawing Sheets

TWO-PART BEVELING WHEEL FOR IMPROVED POSITIONING OF BEVEL CONTOURS ON OPHTHALMIC LENSES

TECHNICAL FIELD OF THE INVENTION

The present invention relates to a bevel edging wheel of the type used for edging of an ophthalmic lens edge. More specifically, the present invention relates to a two-piece bevel edging wheel which can more precisely position the bevel on the peripheral edge of an eyeglass lens.

BACKGROUND OF THE INVENTION

Eyeglass lenses made of polycarbonate, high index, CR-39, glass and materials like Trivex (PPG tm) are known in the art. In order to finish and make these lenses ready for fitting into the eyeglass frame, it is necessary to bevel edge the outer periphery of the lens to give it the proper cross-section to fit in an eyeglass frame. Typically, this is done by an automatic diamond wheel bevel edging machine which includes a rough cut wheel for cutting out the shape and a bevel edging wheel for providing the final contour. Depending on the lens material being ground, the grinding process occurs differently. For example, the harder the material, the faster the process occurs in grinding; the softer the material, the slower the material is removed and the lesser the effect of the grinding wheel on the lens.

Typically, a lens bevel edging machine will be required to grind every type of lens material available. In the past, when glass and CR-39 were the only lens material being supplied by lens manufacturers, the process was easier to perform. Today, with five lens materials readily available and at least one new lens material being developed each year, the diamond wheel is required to grind varying lens materials on one machine with the same results being required for the placement of the contour of the lens edge.

Both two piece and one piece two-grit bevel edging wheels are well known in the art. Two-piece beveling wheels are beneficial in that bevel geometry of the wheel is more precise and it is easier to define the split of the two fine grits of diamond that are used in the beveling wheel at the apex of the convex bevel groove in the beveling wheel. The two different fine grits of varying size being important to influencing the correct position of the contour of the lens edge. With today's many different materials, changing the size differential of the two fine grits of diamond on each half of the wheel is not adequate to influence the position of the bevel while affording a lens edge finish that is acceptable in the industry.

Therefore, it is a goal in the art to provide a two-piece bevel edging wheel where each of the two parts of the bevel edging wheel have two different bonding matrices which can influence the position of the lens edge contour without consideration of the type of lens materials and give substantially identical lens edge contours on all types of lens materials.

SUMMARY OF THE INVENTION

In accordance with the present invention, there is provided a bevel edging wheel for the edge finishing of an ophthalmic eyeglass lens blank. The lens comprises a hub portion which is adapted for attachment to a rotary power source. The wheel includes an outer circumferential cutting surface having a width. The outer circumferential cutting surface includes an abrasive grit attached thereto an also has a circumferential groove therein for forming an edge contour onto an optical lens. The wheel includes two disc like portions mated at the apex of the "v" shaped groove so as to form the peripheral contour of the wheel. Each disc portion of the wheel is manufactured separately and has at least a different bond hardness grade on its circumferential cutting surface.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

In accordance with the present invention, there is provided a rotary edging wheel generally shown at 10. The rotary edging wheel 10 is shown as a bevel edging wheel which includes a circumferential indentation generally shown at 12. A central hub portion 14 is provided for attachment of the wheel to a suitable bevel edging machine mandrel.

Figure 1:
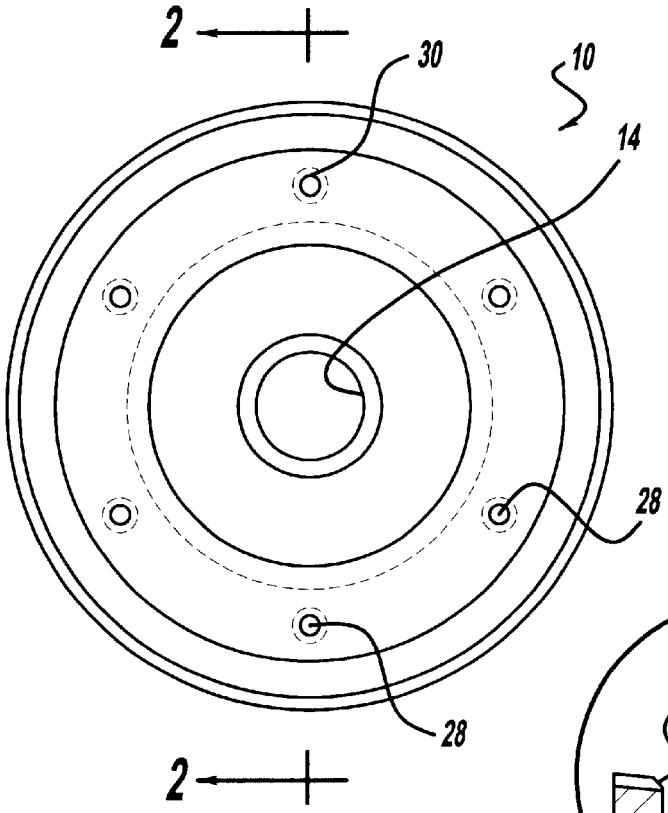
FIG. 1 is a side view of the bevel edging wheel of the present invention.
Figure 2:
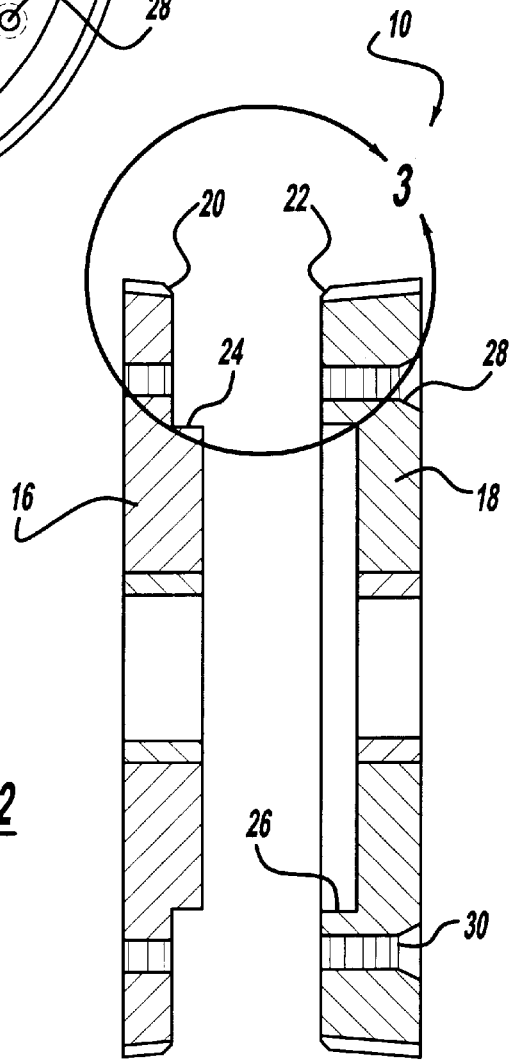
FIG. 2 is a sectional view taken along line 2—2 of FIG. 1, showing a two-part assembly bevel edging wheel.
Figure 3:
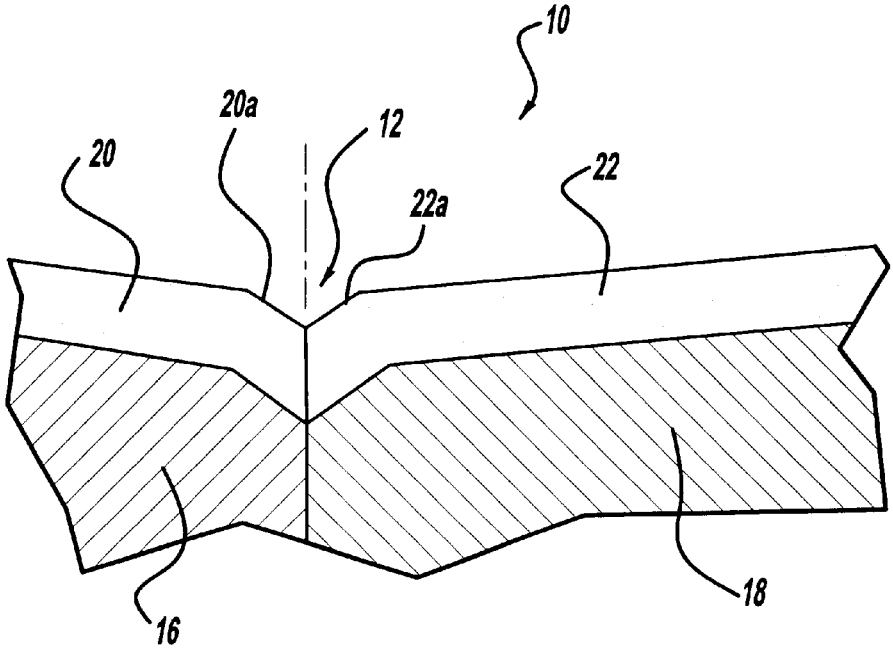
FIG. 3 is a detailed exploded sectional view showing the bevel edging wheel of FIG. 2.

As shown in FIG. 2, in order to facilitate the use of differing bond hardness materials, in a preferred embodiment a two-piece rotary edging wheel construction is utilized. Thus, a first portion 16 and a second portion 18 are configured to fit between one another to form the abrasive "V" surface 12. Abrasive "V" surface 12 includes a first abrasive matrix 20 for forming the first surface 20(*a*) and a second abrasive matrix 22 for forming the second abrasive surface 22(*a*). As shown in FIG. 2, a circular ledge 24 of the first portion 16 fits into a mating circular indentation 26 in the second portion 18 to provide a bevel edging wheel 10. Thereafter, fasteners are inserted in fastener holes 28 and 30 for securing the unit together. The first abrasive surface 20(*a*) is the surface which forms the bevel on the plus side or base surface of an optical lens, and the second abrasive surface 22(*a*) is the surface which forms the bevel on the minus (typically concave) side of the optical lens. Typically, a sintered metal bond is utilized for both the first abrasive matrix and the second abrasive matrix. The bond is sintered directly onto the first 16 or second 18 portion of the wheel on the operative face. A thickness of material is provided to allow for dressing of the surface if necessary. While not preferred, the entire wheel could be made of a sintered structure provided the proper bond hardness of the first and second surfaces is maintained. Typically, the abrasive grit in the first abrasive matrix 20 is finer than the abrasive grit in the second abrasive matrix 22. In a typical application, the finer grit is used on the plus side of the lens and the coarser grit is used on the minus side of the lens.

In the present invention, it has been found that the using of a bond hardness which is harder in one of the abrasive matrices provides improved consistency when cutting the bevel edge irrespective of the lens material. Thus, with respect to the first abrasive matrix 20 and the second abrasive matrix 22, the grit in the first abrasive matrix is finer than the courser grit in the second abrasive matrix. Typically, the grit size difference is from 1 to 3 grit sizes, with a preferred grit size being 270/325 mesh in the fine side and 200/230 mesh in the course side. Generally, the first abrasive matrix has a bond matrix (plus side) with an effective hardness greater than the second abrasive matrix. Typically, this effective hardness differential is accomplished by using a harder bond matrix. However, a softer bond matrix could be made to have a harder effective bond by increasing the concentration of diamond abrasive grit particles. In a preferred embodiment, the fine grit size has a harder bond than the coarse grit side. Typically, the differential in hardness between the bonds is from 5 to 50 Rockwell B scale hardness, with the preferred range of bond hardness being of from about 5 to 50 on the coarse side and the harder fine side being from 80 to 113 on the Rockwell B scale. Generally, the bond hardness of the first abrasive matrix is from about 45 to about 125 (Rockwell B) with the second abrasive matrix having a bond hardness of from about 40 to about 110, typically, the bond hardness of the first abrasive matrix is from about 85 to about 125 and the second abrasive matrix has a bond hardness of from about 80 to about 110, and preferably the bond hardness of the first abrasive matrix is from about 65 to about 125 and the second abrasive matrix has a bond hardness of from about 40 to about 110.

Typically, diamond is used as the abrasive. The raw hardness of the bond is harder and, therefore, a harder coarse side bond may be utilized while maintaining the proper differential between the bond hardness. Also, a harder acting bond can be accomplished by using a light concentration of diamond particles in the softer bond, which increases the effective hardness of the bond.

In operation, beveling of lenses with the variation of hardness of the abrasive matrices taught herein advantageously allows use of a single wheel for bevel edging of optical lenses irrespective of the material used. These results were quite unexpected based on use of pre-existing duel grit bevel edging wheels. Further understanding of the present invention will be had in view of the examples given below.

EXAMPLE 1

A bevel edging wheel is produced in two portions, one having a plus side abrasive matrix having a synthetic diamond grit material with a grit size of 400/325 embedded in a sintered metal bond having a bond hardness of 100 Rockwell B. This bond is a sintered metal bond having a hardness of about 95 to about 100, including 80% by weight iron powder, 5% by weight Ferropho and 15% by weight copper powder. A second portion includes a minus side abrasive matrix having a synthetic diamond grit material in a size of 270/325 embedded in a sintered metal bond having a hardness of about 75 to about 80. The minus side matrix includes 76.5% by weight copper, 8.5% by weight tin powder and 15% by weight graphite powder.

The wheel is assembled and placed in a WECO Model No. 440 machine. The wheel is found to provide consistent beveling of ophthalmic lenses made of polycarbonate CR39, Trivex™ and glass.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A bevel edging wheel for edge finishing of an optical lens comprising:

a hub portion for attachment to a rotary power source; and an outer circumferentiated cutting surface having a width, said surface including a bevel edging portion including a first abrasive surface and a second abrasive surface adapted for forming a bevel edge on a plastic lens;

said first abrasive surface comprising a first abrasive matrix, and said second abrasive surface comprising a second abrasive matrix wherein one of said first abrasive matrix or said second abrasive matrix having an effective hardness greater than the other;

wherein said first and second abrasive matrices are bonded to the wheel;

wherein said bevel edging portion is in the form of a substantially V-shaped groove having a plus curve side as said first abrasive surface and a minus curve side as said second abrasive surface, and wherein a finer grit is used in the first abrasive matrix and a courser grit is used in the second abrasive matrix;

wherein the finer abrasive grit is from 1 to 3 grit sizes less than said coarser abrasive grit.

2. The bevel edging wheel of claim 1 wherein said first abrasive matrix has an effective hardness greater in hardness than said second abrasive matrix.

3. The bevel edging wheel of claim 2 wherein the wheel is a two part wheel, with one part forming said first abrasive surface and a second part forming a second abrasive surface.

4. The bevel edging wheel of claim 3 wherein said grit is a diamond abrasive grit material in said matrix.

5. The bevel edging wheel of claim 1 wherein the differential of hardness between said first abrasive matrix and said second abrasive matrix is from about 5 to about 50 on a Rockwell B scale.

6. The bevel edging wheel of claim 5 wherein the bond hardness of the first abrasive matrix is from about 45 to about 125 and said bond hardness of said second abrasive matrix is from about 40 to about 110.

7. The bevel edging wheel of claim 5 wherein said grit is a diamond abrasive grit material in said matrix.

8. The bevel edging wheel of claim 1 wherein the abrasive grit is a non-diamond abrasive grit material and said differential is greater than 5.

9. A bevel edging wheel for edge finishing of an optical lens comprising:

a hub portion for attachment to a rotary power source; and an outer circumferentiated cutting surface having a width, said surface including a bevel edging portion including a first abrasive surface and a second abrasive surface adapted for forming a bevel edge on a plastic lens;

said first abrasive surface comprising a first abrasive matrix, and said second abrasive surface comprising a second abrasive matrix wherein said first abrasive matrix has a hardness greater than said second abrasive matrix;

wherein said bevel edging portion is in the form of a "V" groove having a plus curve side as said first abrasive surface and a minus curve side as said second abrasive surface, and wherein a finer grit is used in the first abrasive matrix of said plus side and a courser grit is used in the second abrasive matrix;

wherein the finer abrasive grit is from 1 to 3 grit sizes less than said coarser abrasive grit.

10. The bevel edging wheel of claim 9 wherein said first and second abrasive matrices are bonded to the wheel.

11. The bevel edging wheel of claim 9 wherein the differential of hardness between said first abrasive matrix and said second abrasive matrix is from about 5 to about 50 on a Rockwell B scale.

12. The bevel edging wheel of claim 11 wherein the wheel is a two part wheel, with one part forming said first abrasive surface and a second part forming a second abrasive surface.

13. The bevel edging wheel of claim 9 wherein the abrasive grit is a non-diamond abrasive grit material and said differential is greater than 5.

14. The beveled edging wheel of claim 11 wherein the bond hardness of the first abrasive matrix is from about 85 to about 125 and said bond hardness of said second abrasive matrix is from about 80 to about 110.

15. A two-piece bevel edging wheel for edge finishing of an optical lens comprising:

a first portion and a second portion mating together for forming a wheel assembly including an outer circumferentiated cutting surface having a width, said surface including a bevel edging portion including a first abrasive surface on said first portion and a second abrasive surface on said second portion adapted for forming a bevel edge on a plastic lens;

said first abrasive surface comprising a first abrasive matrix, and said second abrasive surface comprising a second abrasive matrix wherein said first abrasive matrix has a hardness greater than said second abrasive matrix, and said first abrasive matrix has a finer grit than said second abrasive matrix;

wherein said bevel edging portion is in the form of a "V" groove having a plus curve side as said first abrasive surface and a minus curve side as said second abrasive surface, and wherein a finer grit is used in the first abrasive matrix of said plus side and a courser grit is used in the second abrasive matrix;

wherein the finer abrasive grit is from 1 to 3 grit sizes less than said coarser abrasive grit.

16. The bevel edging wheel of claim 15 wherein said first and second abrasive matrices are bonded to the wheel.

17. The bevel edging wheel of claim 15 wherein the differential of hardness between said first abrasive matrix and said second abrasive matrix is from about 5 to about 50 on a Rockwell B scale.

18. The bevel edging wheel of claim 15 wherein said grit is a diamond abrasive grit material in said matrix.

19. The bevel edging wheel of claim 15 wherein the abrasive grit is a non-diamond abrasive grit material and said differential is greater than 5.

20. The bevel edging wheel of claim 17 wherein the bond hardness of the first abrasive matrix is from about 65 to about 125 and said bond hardness of said second abrasive matrix is from about 40 to about 110.

* * * * *